US005640808A

United States Patent [19]

Simeone et al.

[11] Patent Number: 5,640,808

[45] Date of Patent: Jun. 24, 1997

[54] ENFORCER

[76] Inventors: Al Simeone, 5 Carlton Ct., Staten Island, N.Y. 10312; George Spector, 233 Broadway Rm. 702, New York, N.Y. 10279

[21] Appl. No.: 370,012

[22] Filed: Jan. 9, 1995

[51] Int. Cl.[6] ..... E06B 1/04

[52] U.S. Cl. ..... 49/504; 292/346

[58] Field of Search ..... 49/504; 70/416, 70/417, 418; 292/340, 346; 52/204.1, 210

[56] References Cited

U.S. PATENT DOCUMENTS

| | | | |
|---|---|---|---|
| 2,489,072 | 11/1949 | Ausubel | 401/460 X |
| 3,963,269 | 6/1976 | Rosenberg | 292/346 |
| 4,074,484 | 2/1978 | Queren | 49/504 X |
| 4,415,191 | 11/1983 | Thorp | 292/340 X |
| 4,635,399 | 1/1987 | Gehrke et al. | 49/504 X |
| 4,770,452 | 9/1988 | Petree | 49/504 X |
| 4,861,082 | 8/1989 | Priola et al. | 292/346 |

FOREIGN PATENT DOCUMENTS

| | | | |
|---|---|---|---|
| 3072 | 7/1931 | Australia | 292/346 |
| 847202 | 7/1970 | Canada | 292/346 |

*Primary Examiner*—Kenneth J. Dorner
*Assistant Examiner*—Jerry Redman
*Attorney, Agent, or Firm*—Goodman & Teitelbaum, Esqs.

[57] ABSTRACT

A security reinforcement device for a doorjamb with a striker plate on an inner face of the doorjamb comprising an elongated flat reinforcing bar having a recessed area on one side edge thereof. A facility is for mounting the elongated flat reinforcing bar onto a rear surface of the doorjamb, with the recessed area located at a forward bent portion of the striker plate, so as to prevent a break-in of a door caused by a sudden force applied to the door by an intruder.

4 Claims, 1 Drawing Sheet

ENFORCER

BACKGROUND OF THE INVENTION

The instant invention relates generally to door anti-burglary systems and more specifically it relates to a security reinforcement device for a doorjamb, which provides support to the door jamb with the striker plate to prevent a break-in of the door.

There are available various conventional door anti-burglary systems which do not provide the novel improvements of the invention herein disclosed.

SUMMARY OF THE INVENTION

A primary object of the present invention is to provide a security reinforcement device for a doorjamb that will overcome the shortcomings of the prior art devices.

Another object is to provide a security reinforcement device for a doorjamb that is an elongated flat reinforcing bar, which will support the doorjamb with the striker plate, so as to prevent a break-in of the door caused by a sudden force applied to the door by an intruder.

An additional object is to provide a security reinforcement device for a doorjamb, in which the elongated flat reinforcing bar will engage with the striker plate at a corner of the doorjamb, so as to prevent the striker plate from being ripped off of the doorjamb, when the sudden force is applied to the door by the intruder.

A further object is to provide a security reinforcement device for a doorjamb that is simple and easy to use.

A still further object is to provide a security reinforcement device for a doorjamb that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
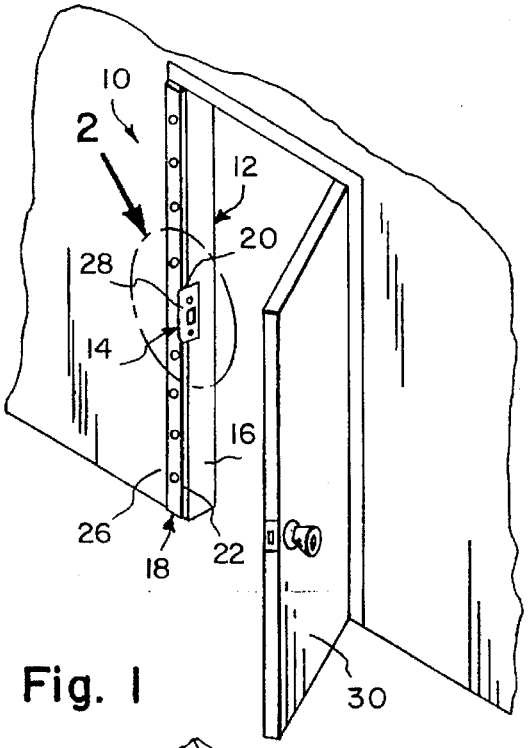
FIG. 1 is a perspective view of a door and doorjamb with the instant invention installed on a rear surface of the doorjamb.

Turning now descriptively to the drawings, in which similar reference characters denote similar elements throughout the several views, FIGS. 1 through 4 illustrate a security reinforcement device 10 for a doorjamb 12 with a striker plate 14 on an inner face 16 of the doorjamb 12, comprising an elongated flat reinforcing bar 18, having a recessed area 20 on one side edge 22 thereof. A facility 24 is for mounting the elongated flat reinforcing bar 18 onto a rear surface 26 of the doorjamb 12, with the recessed area 20 located at a forward bent portion 28 of the striker plate 14, so as to prevent a break-in of a door 30 caused by a sudden force applied to the door 30 by an intruder.

The mounting facility 24 includes the elongated flat reinforcing bar 18 having a plurality of longitudinally spaced apart countersunk apertures 32 therethrough. A plurality of screws 34 are provided. Each screw 34 can enter one countersunk aperture 32 and thread into the rear surface 26 of the doorjamb 12, to facilitate the mounting of the elongated flat reinforcing bar 18 thereto.

Figure 3:
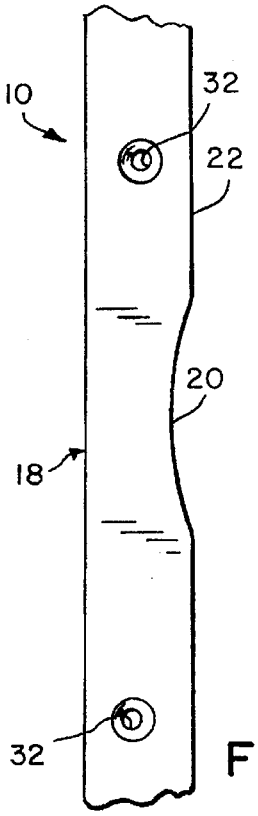
FIG. 3 is a front view as indicated by arrow 3 in FIG. 1, of a portion of the elongated flat reinforcing bar per se.
Figure 2:
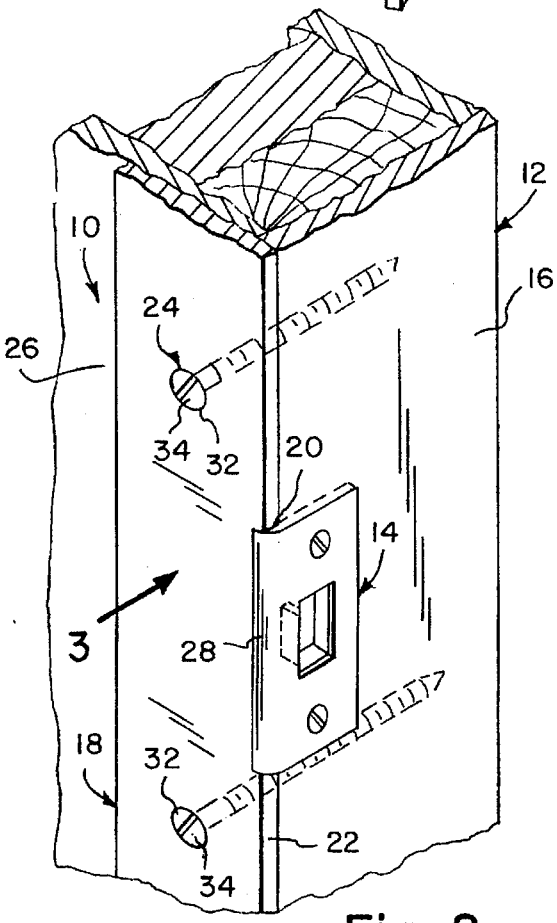
FIG. 2 is an enlarged perspective view of a portion thereof, as indicated by arrow 2 in FIG. 1.

The recessed area 20 in the elongated flat reinforcing bar 18, as best seen in FIGS. 2 and 3, is slightly curved to allow the forward bent portion 28 of the striker to extend in front of the elongated flat reinforcing bar 18 along the recessed area 20, when the elongated flat reinforcing bar 18 is mounted onto the rear surface 26 of the doorjamb 12.

Figure 4:
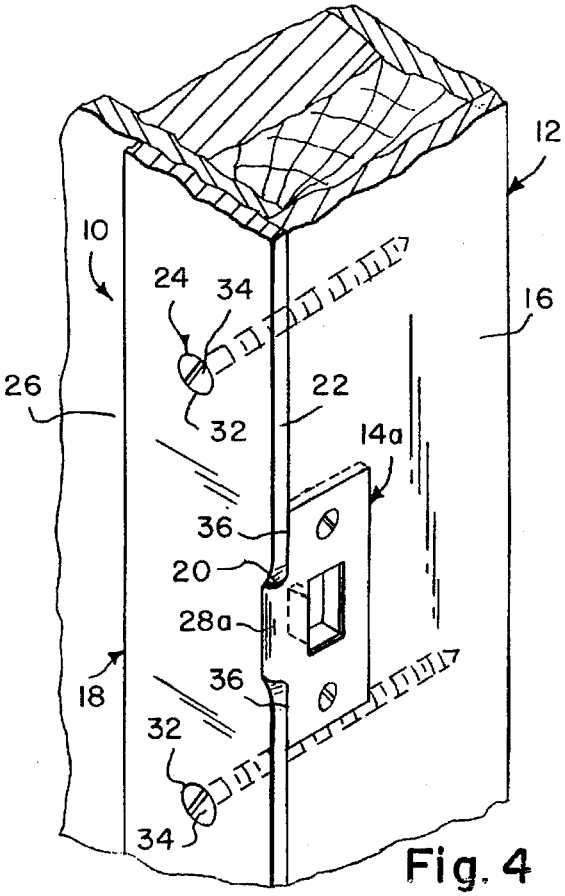
FIG. 4 is an enlarged perspective view similar to FIG. 2, showing a modification thereof of the elongated flat reinforcing bar in engagement with the striker plate at a corner of the doorjamb.

The recessed area 20 in the elongated flat reinforcing bar 18, shown in FIG. 4, is set back to allow the side edge 22 to butt up at a corner against a forward straight edge 36 of the striker plate **14*a* on opposite sides of the forward bent portion 28*a*, when the elongated flat reinforcing bar 18 is mounted onto the rear surface 26 of the doorjamb 12. This prevents the striker plate 14*a* from being ripped off of the doorjamb 12, when the sudden force is applied to the door 30** by the intruder.

The elongated flat reinforcing bar 18 is fabricated out of a strong durable material, such as steel. The elongated flat reinforcing bar 18 can also be made in different widths and lengths, with various amounts of countersunk apertures 32 to fit different sized doorjambs 12.

OPERATION OF THE INVENTION

To use the security reinforcement device 10, a person must first install it by simply placing the elongated flat reinforcing bar 18 against the rear surface 26 of the doorjamb 12 with the recessed area 20 at either the forward bent portion 28 of the striker plate 14, or the forward end portion **28*a* of the striker plate 14*a*. The screws 34 are then threaded into the rear surface 26, through the countersunk apertures 32. The striker plate 14 or 14*a* will now be secure in the doorjamb 12**.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A security reinforcement device in combination with a doorjamb provided with a striker plate, comprising:

said striker plate being mounted on an inner face of the doorjamb;

said security reinforcement device including an elongated flat reinforcing bar having a recessed area on one side edge thereof;

mounting means for securing said elongated flat reinforcing bar onto a rear surface of the doorjamb, so that said elongated flat reinforcing bar is positioned perpendicular to said striker plate; and said recessed area being positioned at a forward bent portion of said striker plate for engaging association therewith to prevent a break-in of a door caused by a sudden force applied to the door by an intruder.

2. A security reinforcement device in combination with a doorjamb provided with a striker plate according to claim 1, wherein:

said elongated flat reinforcing bar is provided with a plurality of longitudinally spaced apart countersunk apertures extending therethrough; and said mounting means includes a plurality of screws, so that one of said screws enters one of said countersunk apertures and threads into the rear surface of the doorjamb to facilitate the securing of said elongated flat reinforcing bar thereto.

3. A security reinforcement device in combination with a doorjamb provided with a striker plate according to claim 1, wherein said recessed area in said elongated flat reinforcing bar is slightly curved to allow said forward bent portion of said striker plate to extend in front of said elongated flat reinforcing bar along said recessed area when said elongated flat reinforcing bar is mounted onto the rear surface of the doorjamb.

4. A security reinforcement device in combination with a doorjamb provided with a striker plate according to claim 1, wherein said recessed area in said elongated flat reinforcing bar is set back to allow said side edge to butt up at a corner thereof against a forward straight edge of said striker plate on opposite sides of said forward bent portion, when said elongated flat reinforcing bar is mounted onto the rear surface of the doorjamb, to prevent said striker plate from being ripped off of the doorjamb when the sudden force is applied to the door by the intruder.

* * * * *